US006439704B1

(12) United States Patent
Silverbrook et al.

(10) Patent No.: US 6,439,704 B1
(45) Date of Patent: Aug. 27, 2002

(54) EJECTOR MECHANISM FOR A PRINT ENGINE

(75) Inventors: Kia Silverbrook, Balmain; Tobin Allen King, Cremorne; Garry Raymond Jackson, Haberfield, all of (AU)

(73) Assignee: Silverbrook Research Pty Ltd., Balmain (AU)

( * ) Notice: Subject to any disclaimer, the term of this patent is extended or adjusted under 35 U.S.C. 154(b) by 0 days.

(21) Appl. No.: 09/608,776

(22) Filed: Jun. 30, 2000

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 6,033,064 A 3/2000 Pawlowski, Jr. et al.

FOREIGN PATENT DOCUMENTS

| | | |
|---|---|---|
| EP | 765757 | 4/1997 |
| EP | 976564 | 2/2000 |
| GB | 2302843 | 2/1997 |
| JP | 9057986 | 3/1997 |

*Primary Examiner*—Huan Tran

(57) ABSTRACT

An ejector mechanism for a print engine includes a support member carrying a plurality of fluid conduits for feeding fluids from a source of each fluid to a printhead of the print engine, one of the fluid conduits being an air feed conduit for feeding air to the printhead. A seal is displaceably arranged relative to the support member for sealing inlet openings of the fluid conduits when the seal is in a first position. The seal is displaceable to a second position to expose the openings of the fluid conduits to place the fluid conduits in fluid communication with their respective sources of fluid. A coil spring acts on the seal for urging the seal to its first position.

9 Claims, 9 Drawing Sheets

EJECTOR MECHANISM FOR A PRINT ENGINE

FIELD OF THE INVENTION

This invention relates to a print engine. The invention has particular application in a print engine for use in an instantaneous print, digital camera. More particularly, the invention relates to an ejector mechanism for the print engine.

BACKGROUND OF THE INVENTION

The print engine of the present invention makes use of a removable print cartridge. Ink to be supplied to the print engine is supplied via the print cartridge and air is also supplied to the printhead of the page width printhead for blowing air over a nozzle guard of the printhead to maintain the printhead free of foreign particles and to inhibit blockage of the ink ejection devices. The ink and the air are fed to the printhead via ink and air inlet pins, respectively. When the print cartridge is removed from the print engine, these pins are exposed. It is necessary to close off the inlet openings of the pins to inhibit the ingress of detritus.

By "page width" is meant that the printhead prints one line at a time on the print media without traversing the print media, or rastering, as the print media moves past the printhead.

SUMMARY OF THE INVENTION

According to the invention, there is provided an ejector mechanism for a print engine, the ejector mechanism including

- a support member carrying a plurality of fluid conduits for feeding fluids from a source of each fluid to a printhead of the print engine, one of the fluid conduits being an air feed conduit for feeding air to the printhead;
- a sealing means displaceably arranged relative to the support member for sealing inlet openings of the fluid conduits when the sealing means is in a first position and the sealing means being displaceable to a second position to expose the openings of the fluid conduits to place the fluid conduits in fluid communication with their respective sources of fluids; and
- an urging means which acts on the sealing means for urging the sealing means to its first position.

The support arrangement may comprise an ink supply member which defines fluid channels for feeding the fluids to the printhead.

The printhead may print using various types of ink and the mechanism may then include a separate fluid conduit for each type of ink plus the air feed conduit. In particular, the printhead may print four different colors of ink being cyan, magenta, yellow and black or, instead, the printhead may print using three colors, being cyan, magenta and yellow with the fourth ink being an ink which is visible in the infrared light spectrum only.

Each fluid conduit may be in the form of a supply pin having a closed end and at least one inlet opening defined in a side wall of a pin. If desired, at least the ink conduits may have a pair of opposed openings defined in the side wall of the pin.

The sealing means may comprise a sealing member of an elastomeric material, the sealing member having a plurality of openings defined therein, each opening being dimensioned such that its associated pin is a snug fit therethrough.

The sealing member may define an opening for each ink supply pin with a land defined on a periphery of the sealing means for closing off the inlet opening of the air supply pin.

The sealing member may be mounted in a molding, the molding being displaceably arranged relative to the support member.

The molding may be held captive relative to the support member.

The urging means may be a coil spring sandwiched between the support member and the molding.

BRIEF DESCRIPTION OF THE DRAWINGS

The invention will now be described by way of example with reference to the accompanying diagrammatic drawings in which.

DETAILED DESCRIPTION OF THE DRAWINGS

Figure 1:
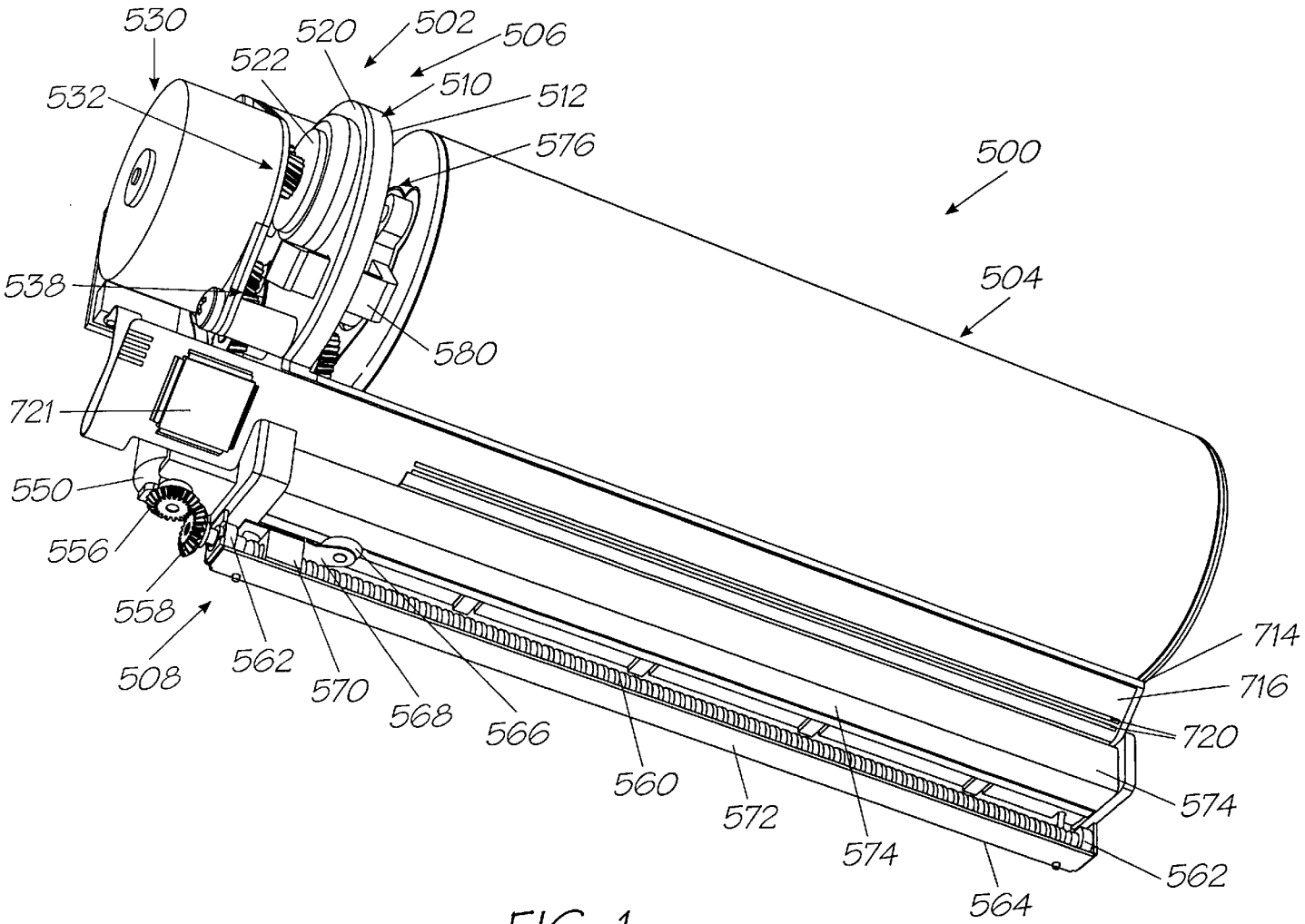
FIG. 1 shows a three dimensional view of a print engine, including components in accordance with the invention.

In the drawings, reference numeral 500 generally designates a print engine, in accordance with the invention. The print engine 500 includes a print engine assembly 502 on which a print roll cartridge 504 is removably mountable.

The print cartridge 504 is described in greater detail in our co-pending applications entitled "A Print Cartridge" (docket number CA02US) and "An Ink Cartridge" (docket number CA04US) filed simultaneously herewith as U.S. Ser. Nos. 09/607,883 and 09/607,251 respectively, the content of that disclosure being specifically incorporated herein by reference.

The print engine assembly 502 comprises a first sub-assembly 506 and a second, printhead sub-assembly 508.

Figure 5:
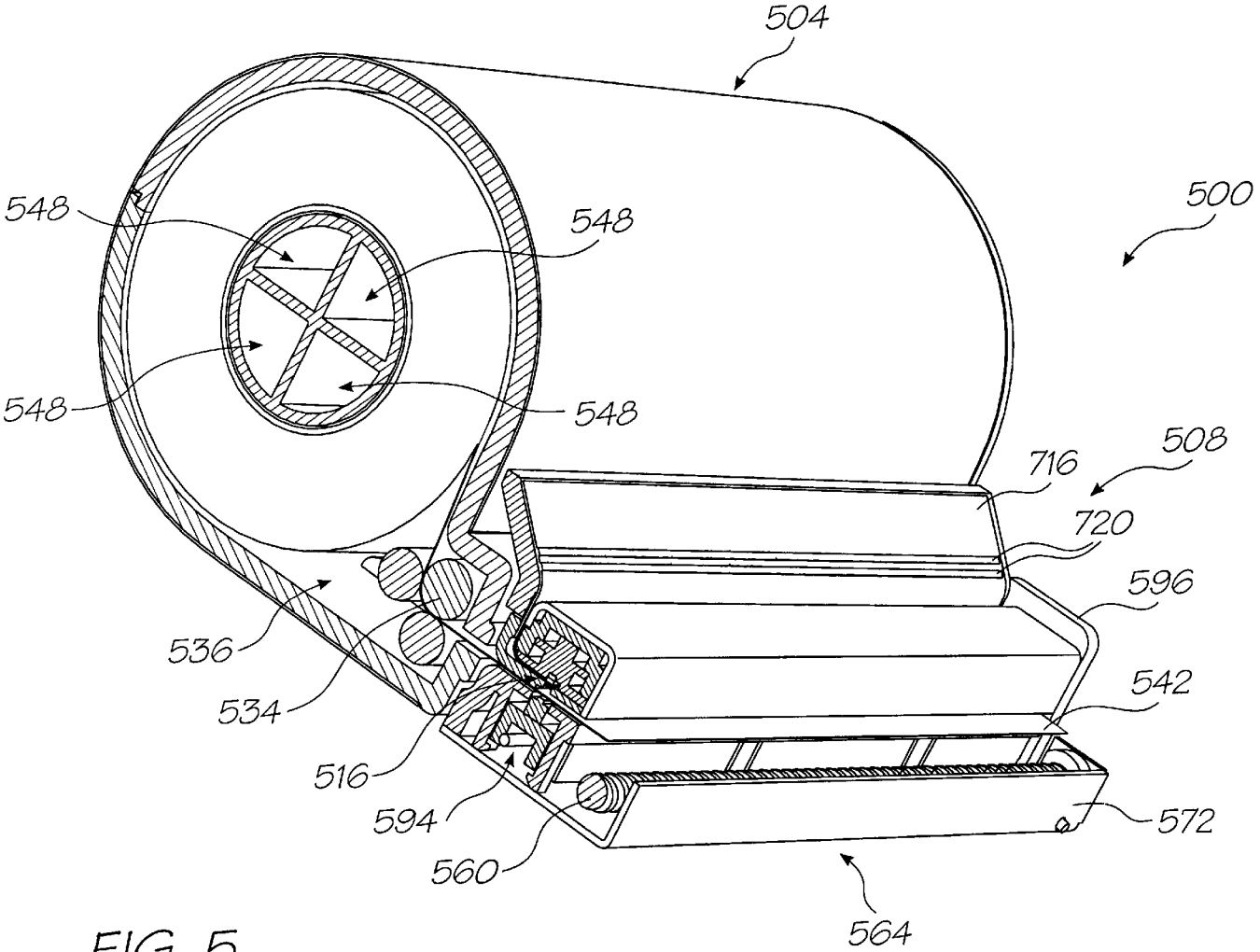
FIG. 5 shows a three dimensional, sectional view of the print engine.
Figure 6:
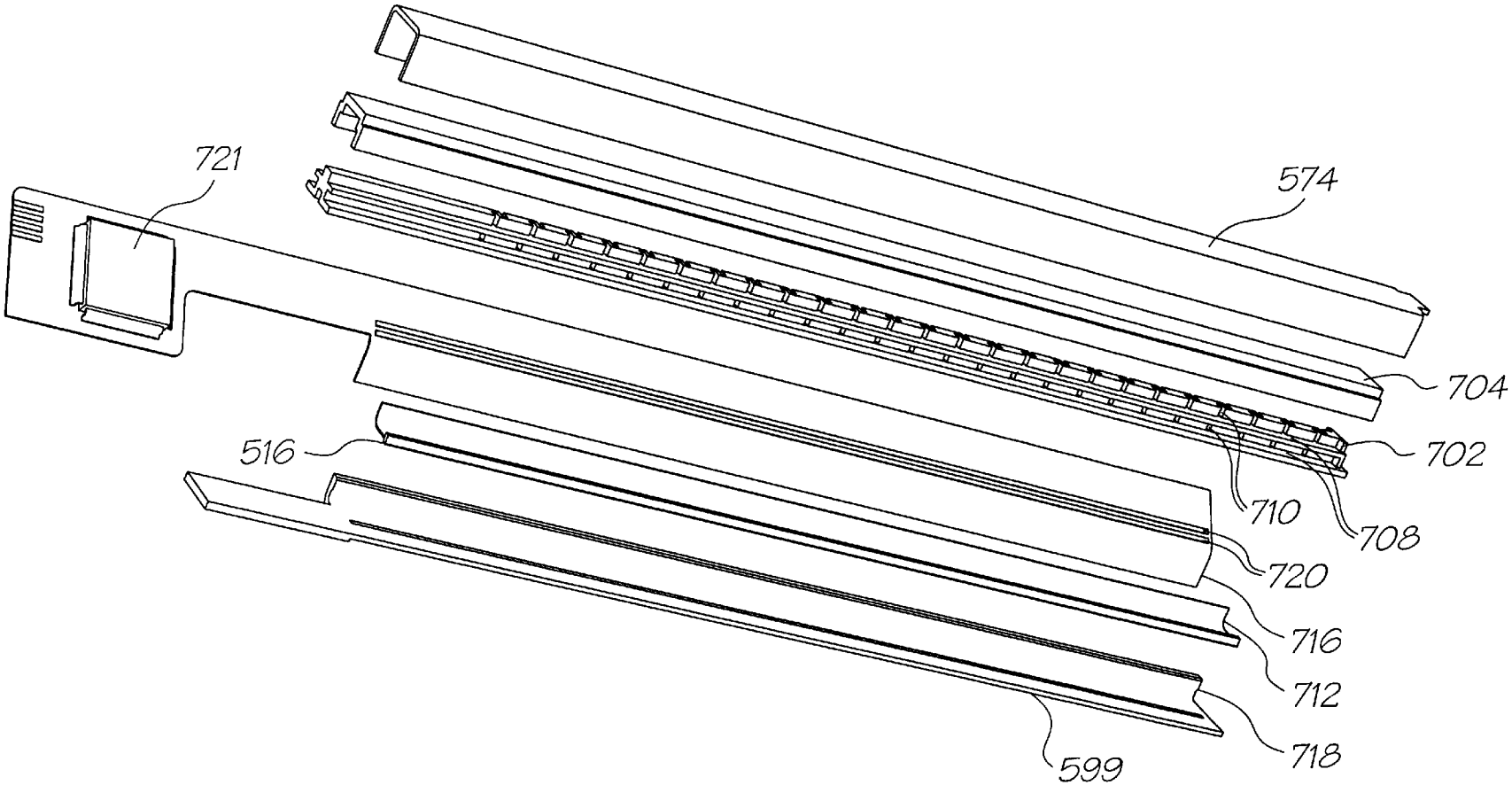
FIG. 6 shows a three dimensional, exploded view of a printhead sub-assembly of the print engine.

The sub-assembly 506 includes a chassis 510. The chassis 510 comprises a first molding 512 in which ink supply channels 514 are molded. The ink supply channels 514 supply inks from the print cartridge 504 to a printhead 516 (FIGS. 5 to 7) of the printhead sub-assembly 508. The printhead 516 prints in four colors or three colors plus ink which is visible in the infrared light spectrum only (hereinafter referred to as 'infrared ink'). Accordingly, four ink supply channels 514 are defined in the molding 512 together with an air supply channel 518. The air supply channel 518 supplies air to the printhead 516 to inhibit the build up of foreign particles on a nozzle guard of the printhead 516.

The chassis 510 further includes a cover molding 520. The cover molding 520 supports a pump 522 thereon. The pump 522 is a suction pump, which draws air through an air filter in the print cartridge 504 via an air inlet pin 524 and an air inlet opening 526. Air is expelled through an outlet opening 528 into the air supply channel 518 of the chassis 510.

Figure 2:
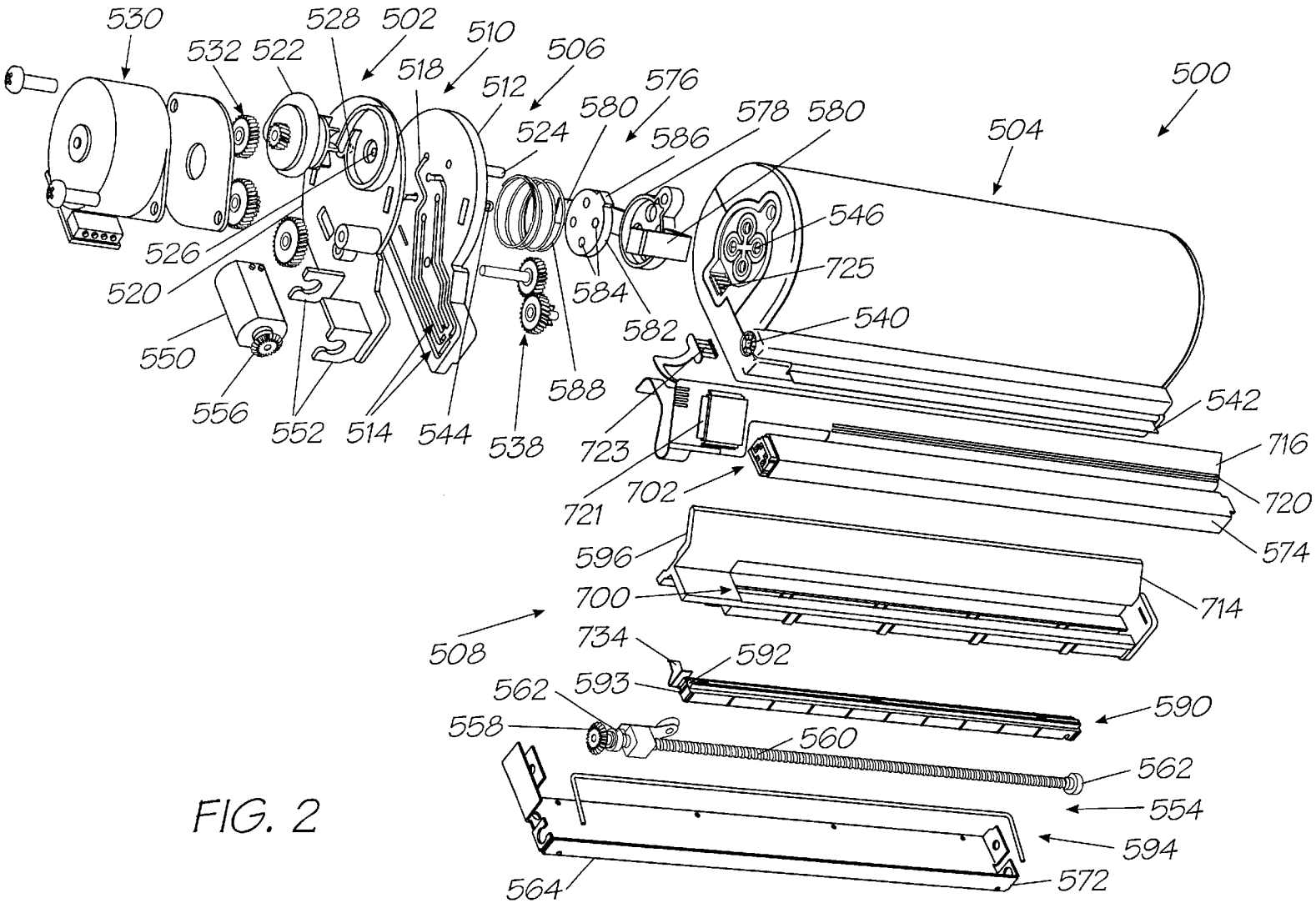
FIG. 2 shows a three dimensional, exploded view of the print engine.

The chassis 510 further supports a first drive motor in the form of a stepper motor 530. The stepper motor 530 drives the pump 522 via a first gear train 532. The stepper motor 530 is also connected to a drive roller 534 (FIG. 5) of a roller assembly 536 of the print cartridge 504 via a second gear train 538. The gear train 538 engages an engagable element 540 (FIG. 2) carried at an end of the drive roller 534. The stepper motor 530 thus controls the feed of print media 542 to the printhead 516 of the sub-assembly 508 to enable an image to be printed on the print media 542 as it passes beneath the printhead 516. It also to be noted that, as the stepper motor 530 is only operated to advance the print media 542, the pump 522 is only operational to blow air over the printhead 516 when printing takes place on the print media 542.

The molding 512 of the chassis 510 also supports a plurality of ink supply conduits in the form of pins 544 which are in communication with the ink supply channels 514. The ink supply pins 544 are received through an elastomeric collar assembly 546 of the print cartridge 504 for drawing ink from ink chambers or reservoirs 548 (FIG. 5) in the print cartridge 504 to be supplied to the printhead 516.

A second motor 550, which is a DC motor, is supported on the cover molding 520 of the chassis 510 via clips 552. The motor 550 is provided to drive a separating means in the form of a cutter arm assembly 554 to part a piece of the print media 542, after an image has been printed thereon, from a remainder of the print media. The motor 550 carries a beveled gear 556 on an output shaft thereof. The beveled gear 556 meshes with a beveled gear 558 carried on a worm gear 560 of the cutter assembly 554. The worm gear 560 is rotatably supported via bearings 562 in a chassis base plate 564 of the printhead sub-assembly 508.

The cutter assembly 554 includes a cutter wheel 566, which is supported on a resiliently flexible arm 568 on a mounting block 570. The worm gear 560 passes through the mounting block 570 such that, when the worm gear 560 is rotated, the mounting block 570 and the cutter wheel 566 traverse the chassis base plate 564. The mounting block 570 bears against a lip 572 of the base plate 564 to inhibit rotation of the mounting block 570 relative to the worm gear 560. Further, to effect cutting of the print media 542, the cutter wheel 566 bears against an upper housing or cap portion 574 of the printhead sub-assembly 508. This cap portion 574 is a metal portion. Hence, as the cutter wheel 566 traverses the capped portion 574, a scissors-like cutting action is imparted to the print media to separate that part of the print media 542 on which the image has been printed.

The sub-assembly 506 includes an ejector mechanism 576. The ejector mechanism 576 is carried on the chassis 510 and has a collar 578 having clips 580, which clip and affix the ejector mechanism 576 to the chassis 510. The collar 578 supports an insert 582 of an elastomeric material therein. The elastomeric insert 582 defines a plurality of openings 584. The openings 584 close off inlet openings of the pins 544 to inhibit the ingress of foreign particles into the pins 544 and, in so doing, into the channels 514 and the printhead 516. In addition, the insert 584 defines a land or platform 586 which closes off an inlet opening of the air inlet pin 524 for the same purposes.

Figure 3:
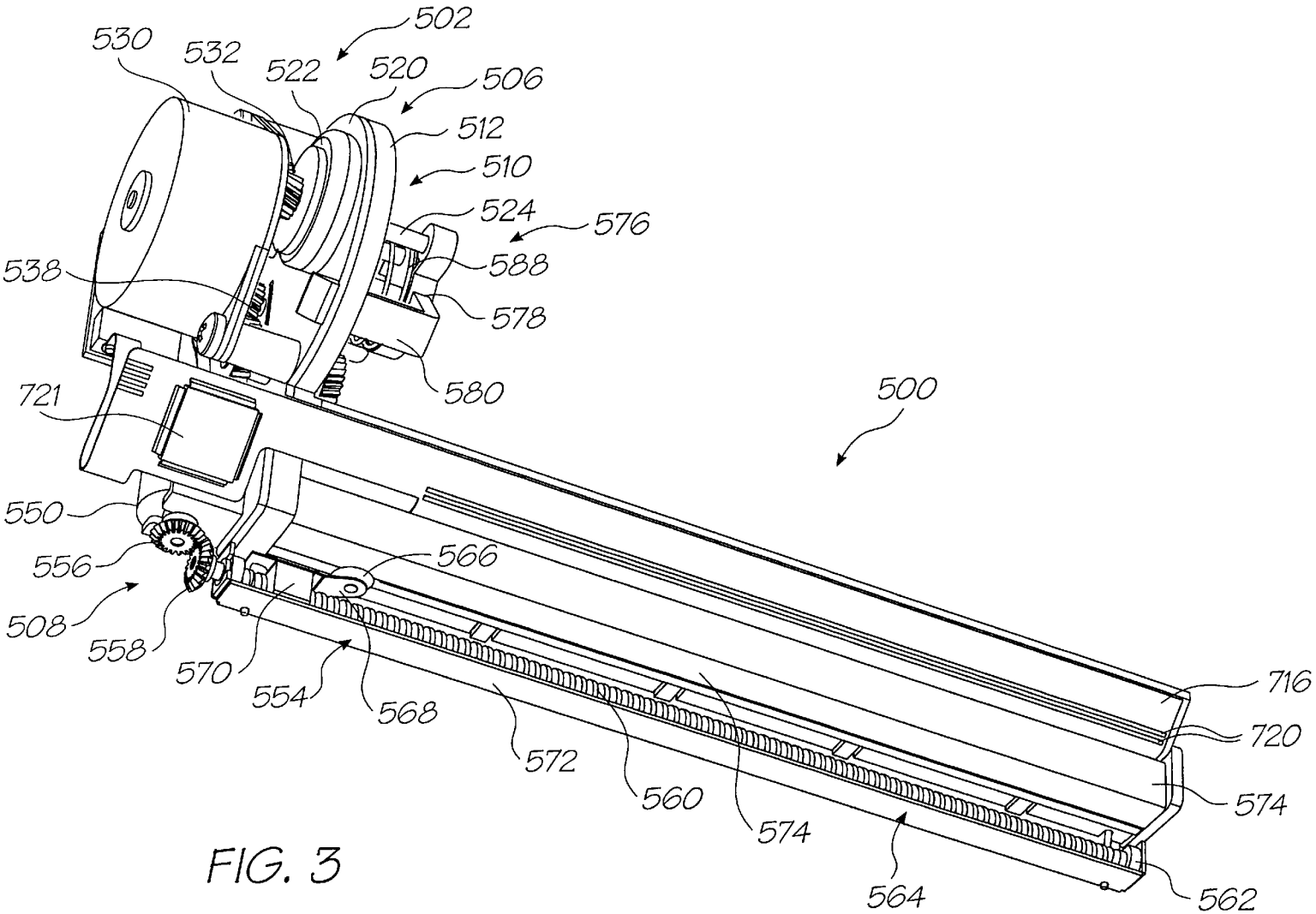
FIG. 3 shows a three dimensional view of the print engine with a removable print cartridge used with the print engine removed.
Figure 4:
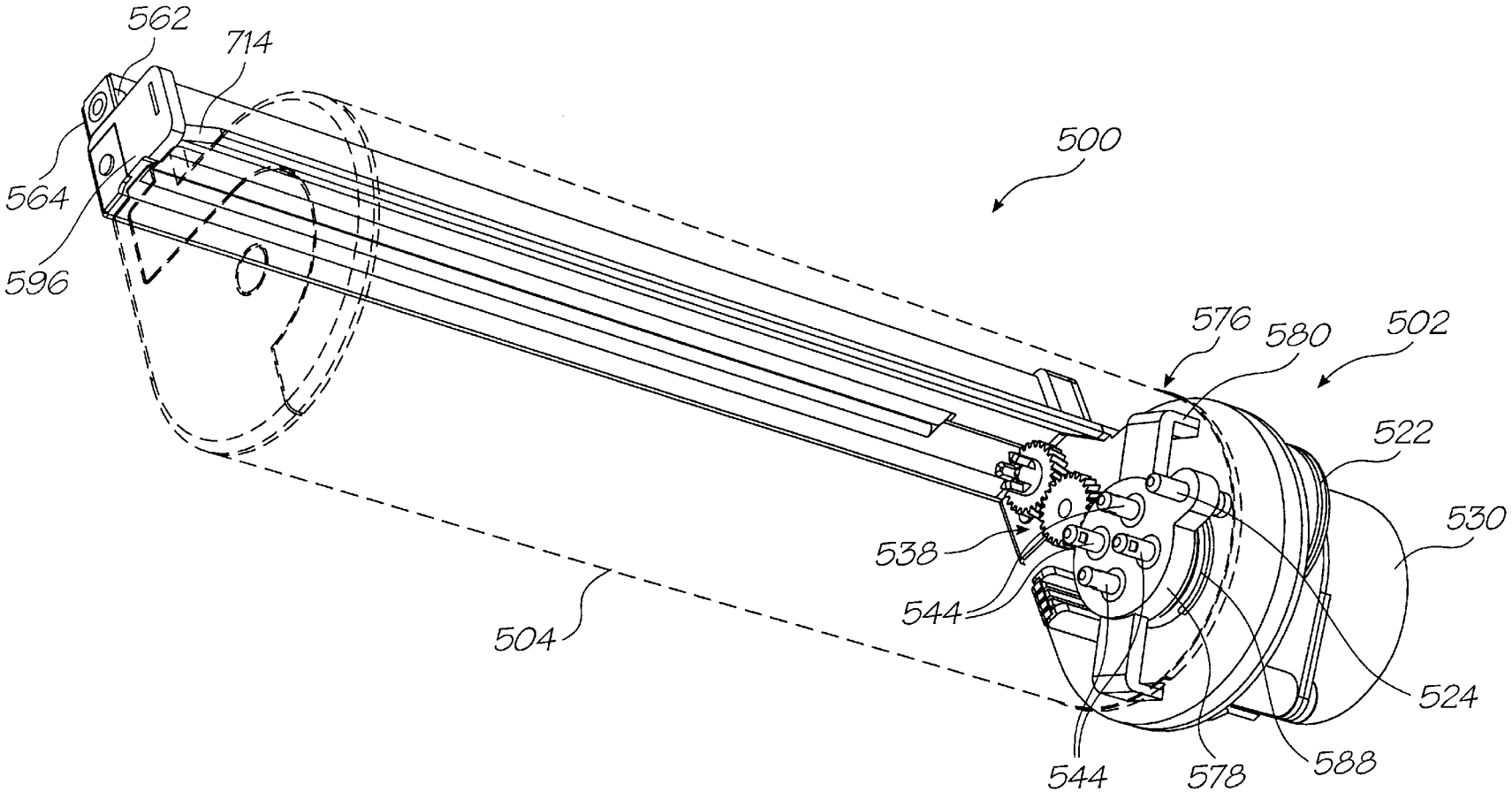
FIG. 4 shows a three dimensional, rear view of the print engine with the print cartridge shown in dotted lines.
Figure 10:
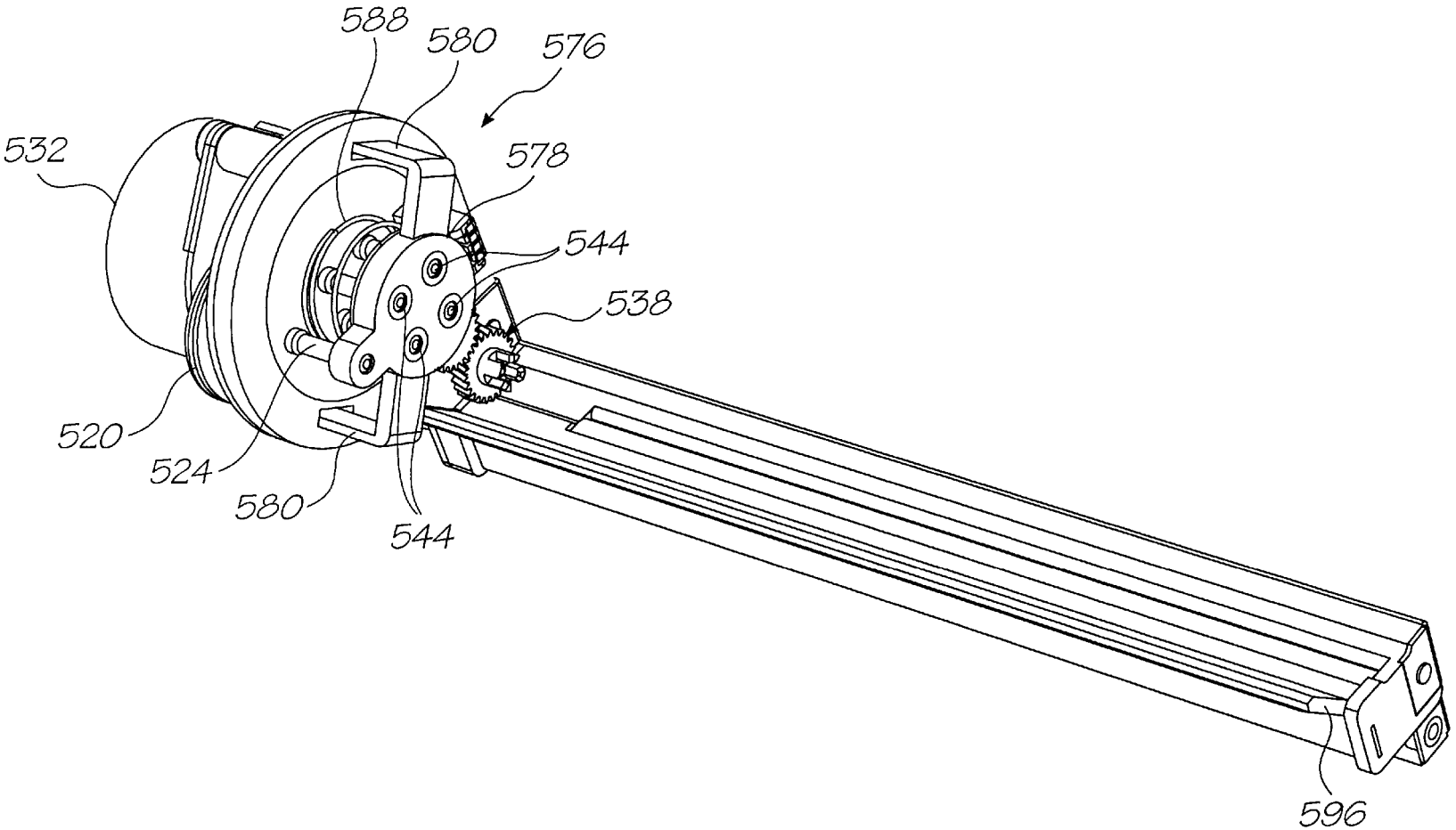
FIG. 10 shows a three dimensional view of part of the print engine with the print cartridge removed.

A coil spring 588 is arranged between the chassis 510 and the collar 578 to urge the collar 578 to a spaced position relative to the chassis 510 when the cartridge 504 is removed from the print engine 500, as shown in greater detail in FIGS. 3 and 10 of the drawings. The ejector mechanism 576 is shown in its retracted position in FIG. 4 of the drawings.

The printhead sub-assembly 508 includes, as described above, the base plate 564. A capping mechanism 590 is supported displaceably on the base plate 564 to be displaceable towards and away from the printhead 516. The capping mechanism 590 includes an elongate rib 592 arranged on a carrier 593. The carrier is supported by a displacement mechanism 594, which displaces the rib 592 into abutment with the printhead 516 when the printhead 516 is inoperative. Conversely, when the printhead 516 is operational, the displacement mechanism 594 is operable to retract the rib 592 out of abutment with the printhead 516.

The printhead sub-assembly 508 includes a printhead support molding 596 on which the printhead 516 is mounted. The molding 596, together with an insert 599 arranged in the molding 596, defines a passage 598 through which the print media 542 passes when an image is to be printed thereon. A groove 700 is defined in the molding 596 through which the capping mechanism 590 projects when the capping mechanism 590 is in its capping position.

An ink feed arrangement 702 is supported by the insert 599 beneath the cap portion 574. The ink feed arrangement 702 comprises a spine portion 704 and a casing 706 mounted on the spine portion 704. The spine portion 704 and the casing 706, between them, define ink feed galleries 708 which are in communication with the ink supply channels 514 in the chassis 510 for feeding ink via passages 710 (FIG. 7) to the printhead 516.

Figure 8:
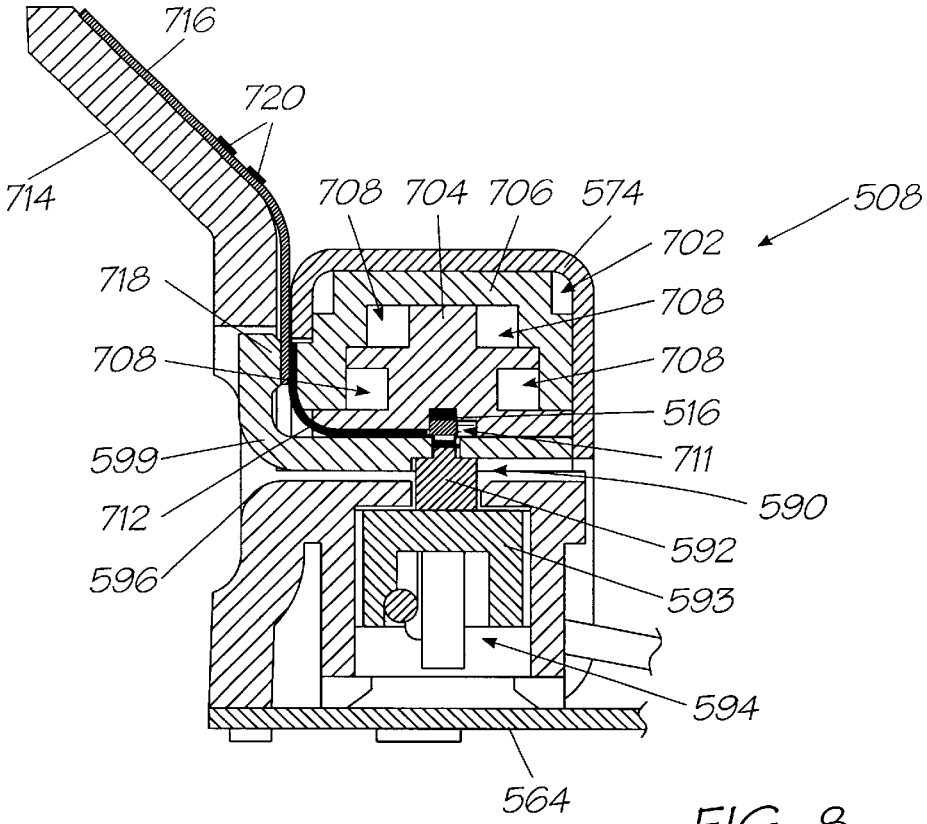
FIG. 8 shows a sectional end view of the printhead sub-assembly with a capping mechanism in a capping position.
Figure 9:
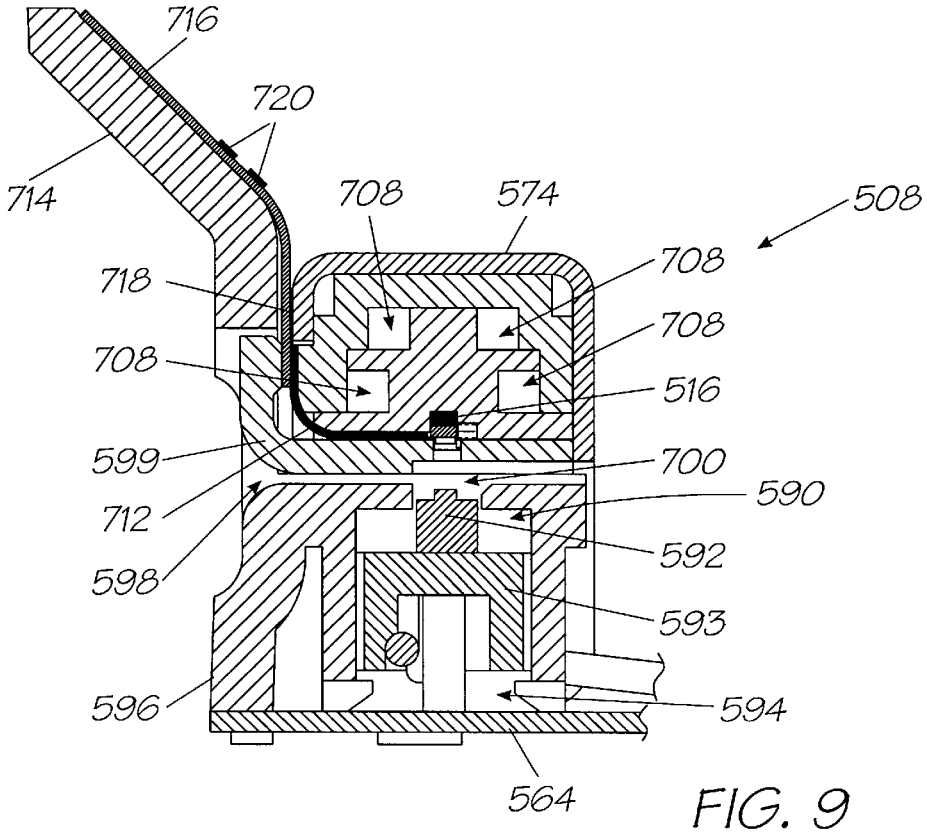
FIG. 9 shows the printhead sub-assembly with the capping mechanism in its uncapped position.

An air supply channel 711 (FIG. 8) is defined in the spine portion 704, alongside the printhead 516.

Electrical signals are provided to the printhead 516 via a TAB film 712 which is held captive between the insert 599 and the ink feed arrangement 702.

The molding 596 includes an angled wing portion 714. A flexible printed circuit board (PCB) 716 is supported on and secured to the wing portion 714. The flex PCB 716 makes electrical contact with the TAB film 712 by being urged into engagement with the TAB film 712 via a rib 718 of the insert 599. The flex PCB 716 supports busbars 720 thereon. The busbars 720 provide power to the printhead 516 and to the other powered components of the print engine 500. Further, a camera print engine control chip 721 is supported on the flex PCB 716 together with a QA chip (not shown) which authenticates that the cartridge 504 is compatible and compliant with the print engine 500. For this purpose, the PCB 716 includes contacts 723 which engage contacts 725 in the print cartridge 504.

Figure 7:
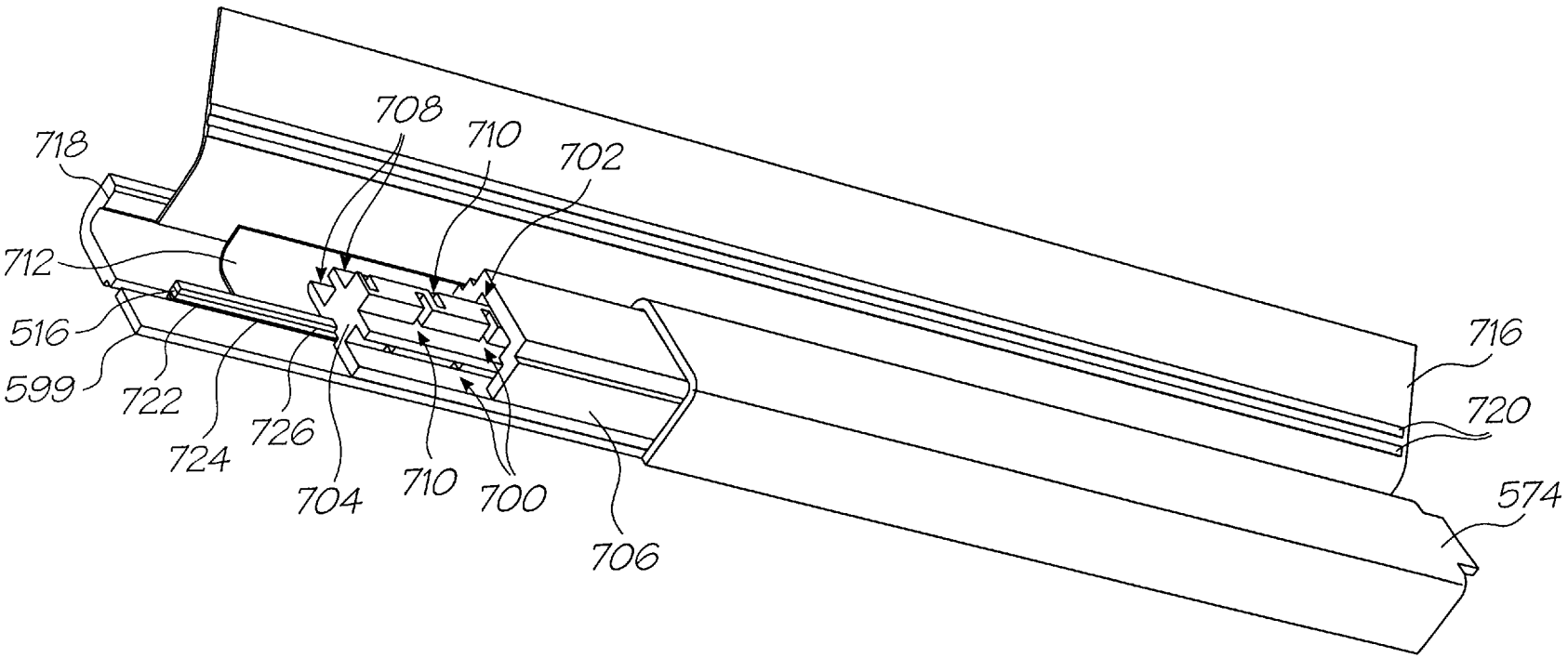
FIG. 7 shows a partly cutaway view of the printhead sub-assembly.

As illustrated more clearly in FIG. 7 of the drawings, the printhead itself includes a nozzle guard 722 arranged on a silicon wafer 724. The ink is supplied to a nozzle array (not shown) of the printhead 516 via an ink supply member 726. The ink supply member 726 communicates with outlets of the passages 710 of the ink feed arrangement 702 for feeding ink to the array of nozzles of the printhead 516, on demand.

Hence, it is an advantage of the invention that an ejector mechanism 576 is provided which, when the print cartridge 504 is removed from the print engine assembly 502, is urged under the action of its coil spring 588 to close the inlet openings of the air supply pin 524 and the inlet openings of the pins 544 via the collar 578.

It is also to be noted that, in order to make the print engine 500 more compact, the size of the print engine assembly 502 is such that most of the components are received within a footprint of an end of the print cartridge 504.

Still further, the use of a mechanical ejector mechanism reduces the number of power consuming components in the print engine 500 enabling a more compact form of print engine 500 to be made.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. An ejector mechanism for a print engine, the ejector mechanism including a support member carrying a plurality of fluid conduits for feeding fluids from a source of each fluid to a printhead of the print engine, one of the fluid conduits being an air feed conduit for feeding air to the printhead;

a sealing means displaceably arranged relative to the support member for sealing inlet openings of the fluid conduits when the sealing means is in a first position and the sealing means being displaceable to a second position to expose the openings of the fluid conduits to place the fluid conduits in fluid communication with their respective sources of fluids; and an urging means which acts on the sealing means for urging the sealing means to its first position.

2. The ejector mechanism of claim 1 in which the support member comprises an ink supply member which defines fluid channels for feeding the fluids to the printhead.

3. The ejector mechanism of claim 2 in which the printhead prints using various types of inks and in which the mechanism includes a separate fluid conduit for each type of ink plus the air feed conduit.

4. The ejector mechanism of claim 3 in which each fluid conduit is in the form of a supply pin having a closed end and at least one inlet opening defined in a side wall of the supply pin.

5. The ejector mechanism of claim 4 in which the sealing means comprises a sealing member of an elastomeric material, the sealing member having a plurality of openings defined therein, each opening being dimensioned such that its associated pin is a snug fit therethrough.

6. The ejector mechanism of claim 5 in which the sealing member defines an opening for each ink supply pin with a land defined on a periphery of the sealing means for closing off the inlet opening of the air supply pin.

7. The ejector mechanism of claim 5 in which the sealing member is mounted in a collar, the collar being displaceably arranged relative to the support member.

8. The ejector mechanism of claim 7 in which the collar is held captive relative to the support member.

9. The ejector mechanism of claim 8 in which the urging means is a coil spring sandwiched between the support member and the collar.

* * * * *